US005169199A

United States Patent [19]

de Ruyter et al.

[11] Patent Number: 5,169,199

[45] Date of Patent: Dec. 8, 1992

[54] OBJECT CARRIER

[76] Inventors: Peter J. de Ruyter, 19116 Kingsbury St., Northridge, Calif. 91326; John R. Bryant, 14749 Calvert St., Van Nuys, Calif. 91411; Roland H. Schneider, P.O. Box 11782, Marina del Rey, Calif. 90295

[21] Appl. No.: 649,418

[22] Filed: Feb. 1, 1991

[51] Int. Cl.[5] ..... B66C 1/12

[52] U.S. Cl. ..... 294/149; 294/74

[58] Field of Search ..... 294/74, 149, 150, 152, 294/154, 156, 138, 31.2, 147

[56] References Cited

U.S. PATENT DOCUMENTS

| | | | |
|---|---|---|---|
| 3,947,927 | 4/1976 | Rosenthal | 294/147 X |
| 3,994,048 | 11/1976 | Rosenthal | 294/147 X |
| 4,114,838 | 9/1978 | Knauf | 294/147 X |
| 4,431,226 | 2/1984 | Weilert | 294/150 |
| 4,470,528 | 9/1984 | Dyess | 294/147 X |

FOREIGN PATENT DOCUMENTS

| | | | |
|---|---|---|---|
| 963214 | 7/1950 | France | 294/149 |
| 2577123 | 8/1986 | France | 294/147 |
| 2588481 | 4/1987 | France | 294/156 |

*Primary Examiner*—Margaret A. Focarino
*Assistant Examiner*—Dean J. Kramer

[57] ABSTRACT

Disclosed is an object carrier comprising a combination of a strap member and a hook-and-fabric-type fastener. The fabric element of the hook-and-fabric-type fastener covers substantially the entire external surface of the strap member. A ring is attached to one end of the strap member and the hook element of the hook-and-fabric-type fastener is attached to the other end. There is a handle on the external surface near the ring. The strap member is wrapped tightly about an object to be carried, with the hook element drawn through the ring and then passed into engagement with the fabric element.

13 Claims, 3 Drawing Sheets

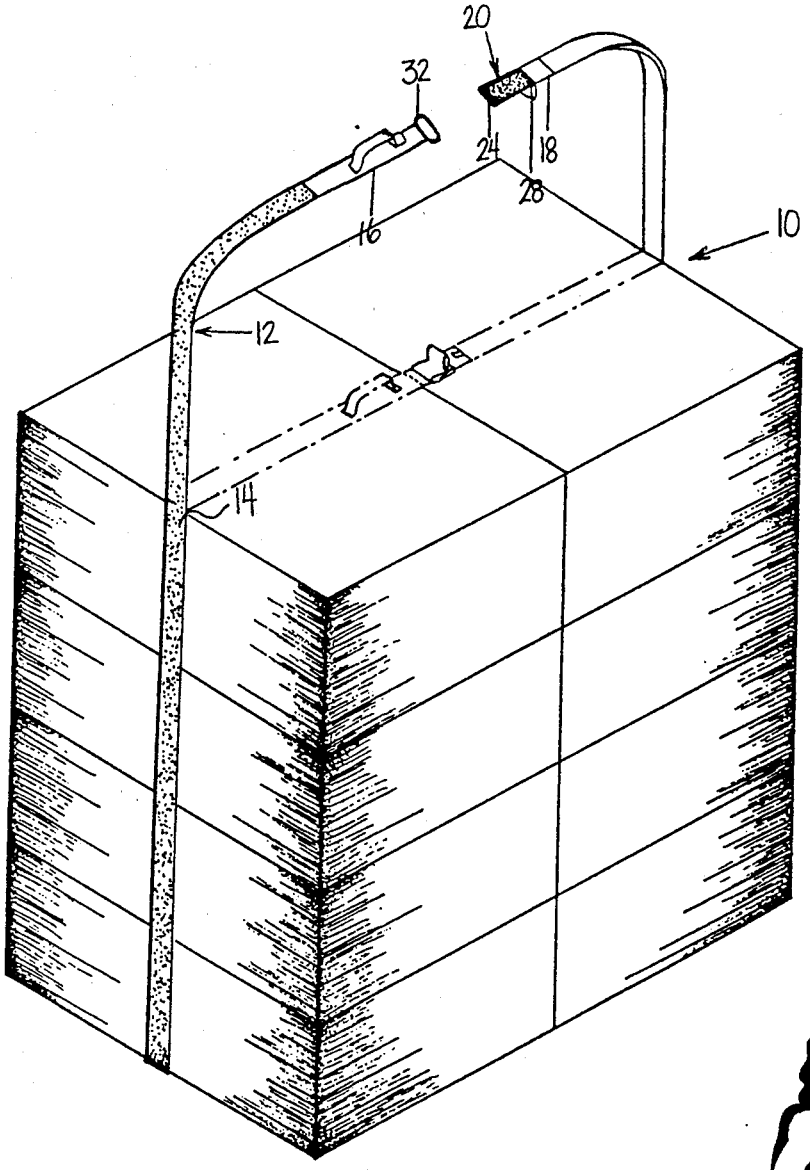
FIG. 4
FIG. 3
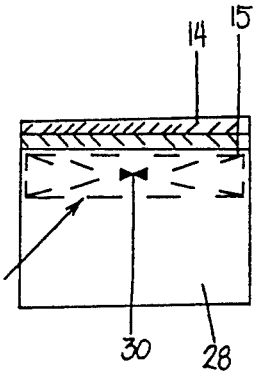
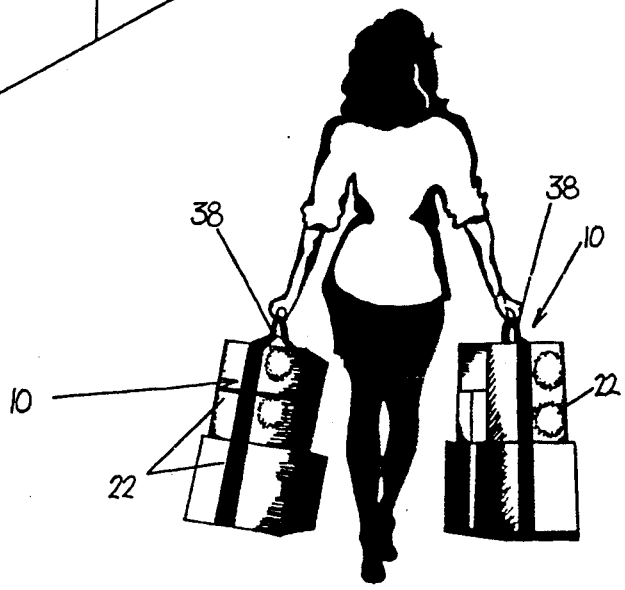
FIG. 5

OBJECT CARRIER

BACKGROUND OF THE INVENTION

1. Field of the Invention

This invention relates to a object carrier in the form of a strap that is wrapped about the objects to be carried and secured tightly around these objects by means of a hook-and-fabric-type fastener which is integral with the strap.

2. Background Discussion

Children have frequently used a belt to carry their books to and from school. The belt is simply looped around the books with the end of the belt drawn through the buckle and then the buckle tightened by putting the catch of the buckle into a hole in the belt. The end of the belt extending through the buckle is used as a handle.

SUMMARY OF THE INVENTION

The present invention has vastly improved on the use of a belt to carry books or other objects wherein a strap with a conventional hook-and-fabric-type fastener integral with the strap is provided.

It is the objective of this invention to provide an object carrier which can be used to carry objects of a wide variety of different shapes and sizes, is strong and can carry heavy loads, as heavy as a human being can possibly lift, is inexpensive to manufacture, is simple and convenient to use, and is acceptable by both men and women, the young and the old, and therefore finds wide-spread use.

The object carrier of this invention has several features, no single one of which is solely responsible for these desirable attributes. Without limiting the scope of this invention as expressed by the claims which follow, its more prominent features will now be discussed briefly. After considering this discussion, and particularly after reading the section of this application entitled, "DETAILED DESCRIPTION OF THE PREFERRED EMBODIMENT," one will understand how the features of this invention provide the above mentioned attributes.

The first feature of this invention is that it uses an elongated strap member which is wrapped around the object or objects to be carried, such as, for example, packages. At one end of the strap member is a ring and at the other end is the hook element of a hook-and-fabric-type fastener. The fabric element of the hook-and-fabric-type fastener is attached to and covers substantially the entire external surface of the strap member. The hooks of the hook element face outwardly from the external surface of the strap member.

The second feature is a retainer means that is positioned near the end of the strap member to which the hook element is attached. This retainer means prevents the end of the strap member from slipping through the ring after it has been drawn through the ring if one simply releases the strap member from one's grip. The retainer means is preferably formed from the body of the strap member by folding and sewing a portion of the strap member into a loop. Because of this construction the retainer means is flexible so that the end of the strap member may be freely pulled from the ring to unloosen the strap member from the object when desired. The retainer means also serves to indicate to the user where the ring is located.

The third feature of this invention is that a handle is secured near the end of the strap member carrying the ring. The handle is on the external surface of the strap member.

Because of the above features, the object carrier of this invention is very simple to use. One simply inserts the end of the strap member with the hook element on it through the ring to form the strap into a closed-loop configuration which encircles the object or packages being carried. The strap member is then drawn tightly around the objects by pulling the end carrying the hook element around the ring to close the loop snugly around the object. The hooks of the hook element are now facing the fabric element to enable the hooks to be pressed against the fabric element to secure the strap member in the closed-loop configuration around the object. The strap is positioned to conveniently locate the handle so that the user can simply grasp the handle and lift the object or objects encircled by the strap member. To release the objects, the hook element is peeled away from the fabric element and the end of the strap with the hook element pulled through the ring. Because the fabric extends substantially over the entire surface of the strap member, the diameter of the looped strap member can be adjusted to accommodate any size or shape object to be carried. This provides the desired versatility of the invention.

BRIEF DESCRIPTION OF THE DRAWING

The preferred embodiment of this invention, illustrating all its features, will now be discussed in detail. This embodiment depicts the novel and non-obvious object carrier of this invention shown in the accompanying drawing, which is for illustrative purposes only. This drawing includes the following figures (Figs.), with like numerals indicating like parts:

FIG. 3 is a cross-sectional view taken along line 3—3 of FIG. 1.

FIG. 4 is a perspective view of the object carrier of this invention wrapped around an assemblage of packages to be carried.

FIG. 5 is a perspective view of a person carrying packages with the object carrier of this invention.

DETAILED DESCRIPTION OF THE PREFERRED EMBODIMENT

Figure 1:
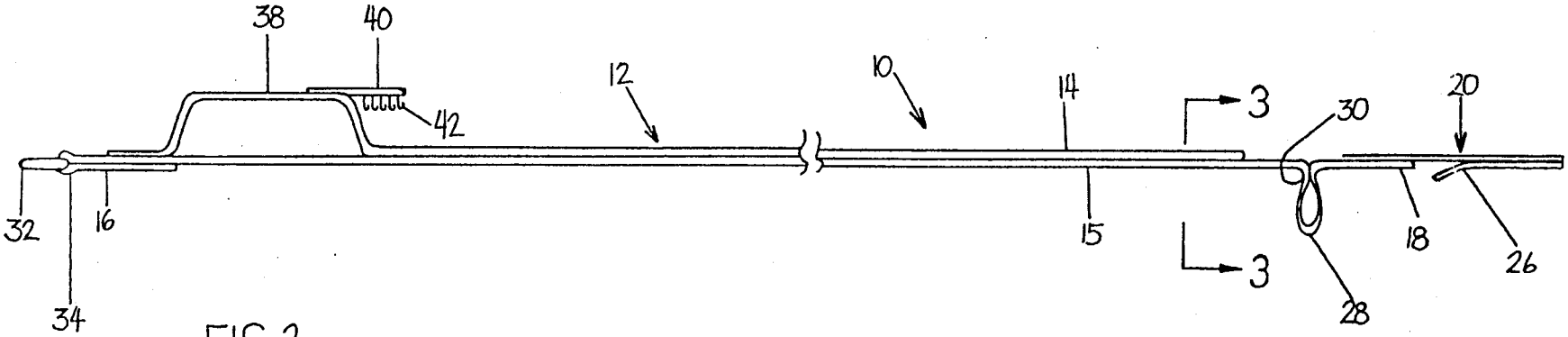
FIG. 1 is a side elevational view of the object carrier of this invention.
Figure 2:
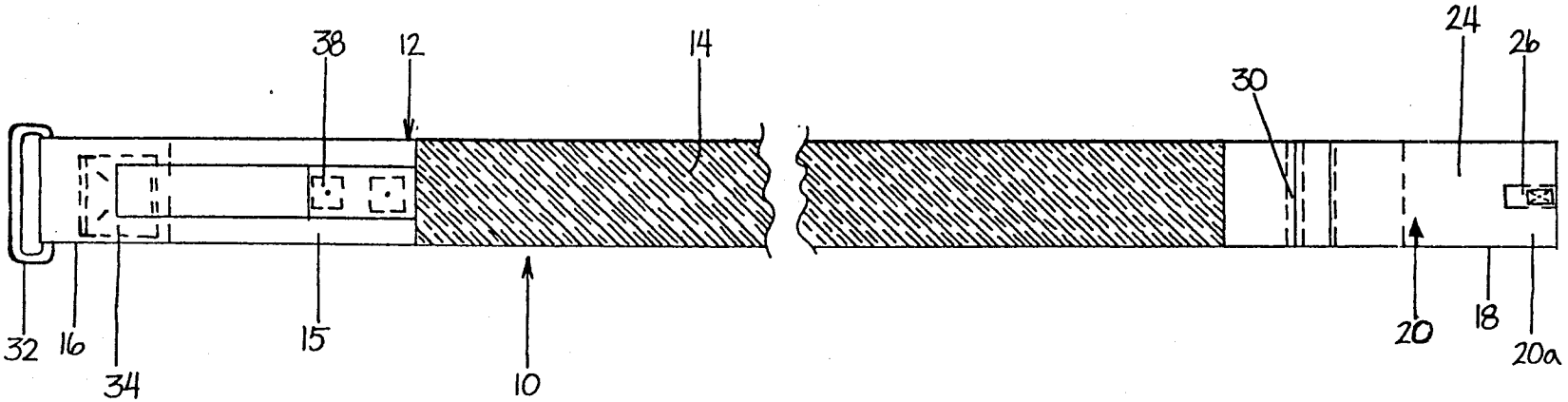
FIG. 2 is a plan view of the object carrier of this invention.

As best illustrated in FIGS. 1 through 3, the object carrier 10 of this invention includes an elongated strap member 12 comprising a fabric material 14 sewn to one surface of a webbing material 15. Preferably, the webbing 15 is made from woven yarns such as, for example, nylon or polypropylene. Typically, it will have a length of from four feet to seven feet, and a width from about one to four inches. The fabric material 14 preferably is a non-woven material made by the Velcro Corporation. This fabric material covers substantially the entire surface of the carrier 10 as viewed in FIG. 4. Note, only the opposed ends 16 and 18 of the strap member 12 are not covered by the fabric material 14. The fabric material 14 is on the external surface of the carrier 10 when the carrier is formed into a looped configuration around an object, or assemblage of packages 22 as illustrated in FIGS. 4 and 5.

The fabric material 14 is one element of a conventional hook-and-fabric-type fastener, for example, a fastener sold under the brand name Velcro® by the Velcro Corporation The hook element 20 of this hook-and-fabric-type fastener comprises a fabric strip 20*a*. This strip 20*a* is attached by sewing it to the end 18 of the strap member 12. The number of hooks 24 on the surface of the strip 20*a* should be sufficient so that, upon placing the hook element into engagement with the fabric material 14, the carrier 10 will be adapted to carry a load in excess of 50 pounds. Typically, this surface area of the hook element ranges between 8 and 20 square inches, with the number of hooks per square inch ranging between 250 and 400. Commercially available hook-and-fabric-type fasteners can typically carry loads as high as 500–700 pounds.

Figure 6:
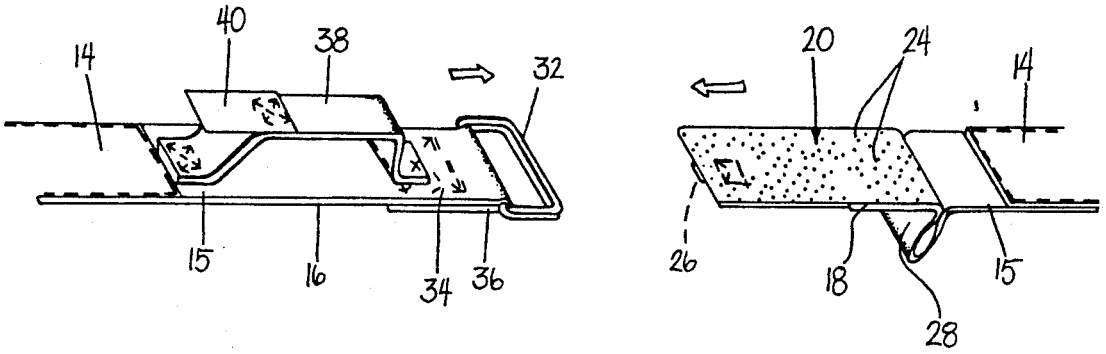
FIG. 6 is perspective view of the ends of the object carrier of this invention after wrapping it about the object to be carried.
Figure 7:
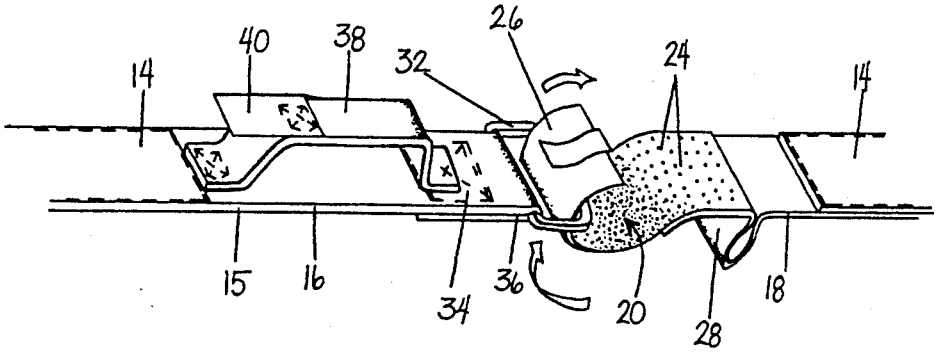
FIG. 7 is perspective view showing the one end of the object carrier being drawn through the ring in the other end.
Figure 8:
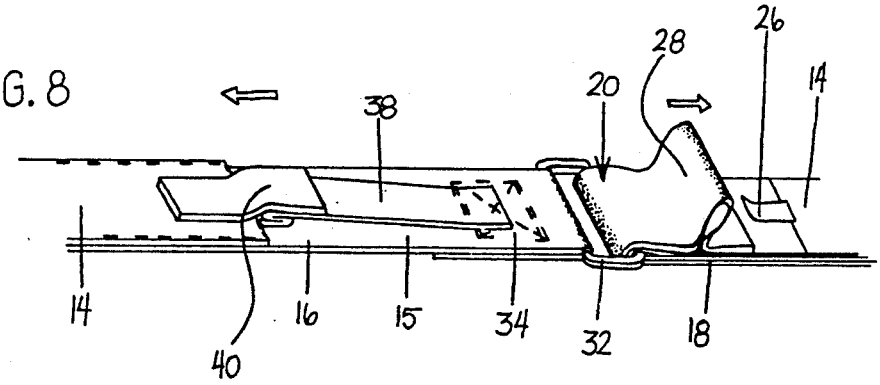
FIG. 8 is perspective view showing the ends of the object carrier secured.

The hooks 24 of the hook element 20 face outwardly from the external surface as best illustrated in FIGS. 2, 6, and 7. Thus, when the end 18 is folded inwardly towards the surface of the fabric material 14 as illustrated in FIGS. 7 and 8, the hooks 24 grasp the fibers (not shown) of the fabric material 14. The strip 20*a* is very thin so that it lies essentially flush with the surface of the fabric material 14 when the hooks 24 engage this fabric material. There is a tab 26 at the distal end of the hook element 20. This tab 26 is used to facilitate peeling the hook element 20 away from the fabric material 14 to pull the hooks 24 from the fibers of the fabric material to unfasten the hook-and-fabric-type fastener. It would extremely difficult to disengage the hooks 24 from the fabric material 14 without the aid of this tab 26. Adjacent the proximal end of the hook element 20 is a retainer loop 28 formed by folding the webbing 15 into a loop as illustrated and sewing the webbing adjacent the loop along a box-X seam 30.

A ring 32 is secured at the end 16 by forming the end of the webbing 15 into a loop threaded through the ring and sewing this looped end 36 with box-X seam 34. The ring 32 may be made of metal or a loop of fabric, or an opening or slit in the end 16 of the webbing 15. This holds the ring 32 securely to the end 16 of the strap member 12. Near the ring 32 is a handle 38 which is formed by simply sewing a strip of material to the webbing 15. As illustrated in FIG. 8, a tab 40 with hooks 42 (FIG. 1) may be attached to the top of the handle 38 so that the handle can be folded inwardly with the hooks engaging the fabric material 14 near the end 16. This allows the handle 38 to be positioned essentially flush with the webbing 15 and the surface of the package. The handle 38 is of the type that allows a person to simply grasp it with one of their hands. Alternately, an elongated shoulder-strap-type handle could be used that allows the handle to be draped over the shoulder of a user.

As illustrated in FIG. 4, to use the object carrier 10 of this invention, the user simply loops the strap member 12 about the assemblage of packages 22 with the surface of the fabric material 14 facing outwardly. The handle 38 is positioned in relation to the assemblage so that the user can easily grasps the handle, lift the assemblage off the ground, and then conveniently carry the assemblage as illustrated in FIG. 5. To secure the object carrier 10, the ends 16 and 18 of the strap member 12 are moved towards each other as illustrated in FIG. 6 and the hook element 20 is drawn through the ring 32 as illustrated in FIG. 7, pulling the retainer loop 28 through the ring. The strap member 12 is tightened to close the loop encircling the packages 22 and create tension in the strap member to hold the packages securely together. Packages 22 of different sizes and shapes may be easily stacked together and secured in a stable assemblage for carrying using the object carrier 10 of this invention. With the strap member 12 tightly wrapped around the assemblage of packages 22, the hooks 24 are in an overlying position relative to the fabric material 14. These hooks 24 are then pressed into the fabric material to hold or lock the strap member 12 tightly around the assemblage of packages 22. The handle 38 is positioned on the top surface of the assemblage so the user may grasp it, lift the assemblage off the ground, and easily carry the assemblage as depicted in FIG. 5. To detach the object carrier 10 from the assemblage of packages 22, the user simply peels away the hook element 20 from the fabric material 14 by grasping the tab 26 and pulling. The retainer loop 28 provides a tactile element which the user feels to easily locate the hook element 20 in a poorly lighted environment and prevents the hook element from slipping back through the ring 32 after the user has pulled the hook element through the ring and then released from his or her grasp the hook element. In other words, if the user accidentally lets go of the hook element 20 after drawing it through the ring 32, the strap member 12 will not become unraveled because the retainer loop 28 stops the strap member from slipping through the ring, but does not prevent the user from pulling the end 18 of the strap member through the ring upon unwrapping the strap member from the assemblage of packages 22.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims.

We claim:

1. An object carrier comprising a strap member having an external surface and an internal surface, and opposed ends, a hook-and-fabric-type fastener having a hook element attached to one of said opposed ends of the strap member and a fabric element attached to the external surface of the strap member, covering substantially the entire external surface, said hook element comprising a plurality of hook means which upon engaging the fabric element grasp the fabric element to connect the hook element and the fabric element in a manner that holds them together, ring means attached to the other opposed end opposite the end to which the hook element is attached, said hook element being oriented so that the hook means face outward from the external surface of the strap member so that, upon drawing the hook element through the ring means to form a loop encircling the object to be carried and folding the strap member inward upon itself, the hook means engage a portion of the fabric element to maintain the strap member in tension around the object, retainer means near the end of the strap member to which the hook element of a hook-and-fabric-type fastener is attached, said retainer means comprising a looped section of the strap member, and handle means near the end of the strap carrying the ring means and on the external side of the strap member.

2. The object carrier of claim 1 wherein the hook and fabric type fastener is adapted to carry a load in excess of 50 pounds.

3. The object carrier of claim 1 wherein the strap member is a woven fabric made of polypropylene yarn.

4. The object carrier of claim 1 wherein the strap member has a length of from 4 feet to 7 feet in length.

5. The object carrier of claim 1 wherein the strap member has a width of from 1 to 4 inches.

6. An object carrier comprising a strap member having opposed sides and opposed ends, ring means at one of said opposed ends, a first hook element of a hook-and-fabric-type fastener at the other of said opposed ends, a fabric element of a hook-and-fabric-type fastener on one of said sides of the strap member, retainer means near the end of the strap member to which the first hook element of a hook-and-fabric-type fastener is attached, said retainer means comprising a loop section of the strap member, and handle means on the same side of the strap member as the fabric element, said first hook element having attached thereto first tab means which facilitates peeling the hook element away from the fabric element.

7. The object carrier of claim 6 wherein the handle means is adapted to be positioned essentially flush with a surface of the object being carried, said handle means including second tab means having a second hook element of a hook-and-fabric-type fastener which is adapted to engage said fabric element to hold said handle means in the essentially flush position until said second tab means is peeled away from the fabric element.

8. The object carrier of claim 6 wherein the hook and fabric type fastener is adapted to carry a load in excess of 50 pounds.

9. The object carrier of claim 8 wherein the strap member is a woven fabric made of polypropylene yarn.

10. The object carrier of claim 9 wherein the strap member has a length of from 4 feet to 7 feet in length.

11. The object carrier of claim 10 where the strap member has a width of from 1 to 4 inches.

12. An object carrier comprising a strap member having at one end ring means and at the other end a first hook element of a hook-and-fabric-type fastener, which a fabric element of the hook and fabric type fastener attached to one side of the strap member and covering substantially the entire surface of said one side of the strap member, said end at which the first hook element is attached being adapted to be inserted into and drawn through the ring means to form the strap member into a closed loop configuration which encircles the object to be carried, said strap member being drawn tightly around the object to close the loop snugly around the object and the first hook element facing the fabric element after being drawn through the ring means to enable said first hook element and fabric element to be pressed together to secure the strap member in the closed loop configuration around the object, retainer means near the end of the strap member to which the first hook element is attached, said retainer means comprising a looped section of the strap member, and handle means near the end of the strap member carrying the ring means and on the same side of the strap member of which the fabric element is attached, said handle means being adapted to be positioned essentially flush with a surface of the object being carried, and including first tab means having a second hook element of a hook-and-fabric-type fastener which is adapted to engage said fabric element to hold said handle means in the essentially flush position until said first tab means is peeled away from the fabric element.

13. The object carrier of claim 12 where said first hook element has attached thereto second tab means which facilitates peeling the first hook element away from the fabric element.

* * * * *